United States Patent [19]

Ahlborn et al.

[11] Patent Number: 4,993,389

[45] Date of Patent: Feb. 19, 1991

[54] ELECTRONIC CONTROL DEVICE FOR CONTROLLING THE FUEL QUANTITY OF AN INTERNAL COMBUSTION ENGINE

[75] Inventors: Frank Ahlborn, Tübingen; Wolfgang Dühlmeyer, Schwieberdingen; Volker Schäfer; Albrecht Sieber, both of Ludwigsburg; Rainer Buck, Tamm; Herbert Käberer, Waldstetten; Alf Löffler, Markgröningen-Talhausen, all of Fed. Rep. of Germany

[73] Assignee: Robert Bosch GmbH, Stuttgart, Fed. Rep. of Germany

[21] Appl. No.: 353,669

[22] PCT Filed: Aug. 12, 1987

[86] PCT No.: PCT/DE87/00352

§ 371 Date: May 8, 1989

§ 102(e) Date: May 8, 1989

[87] PCT Pub. No.: WO88/03607

PCT Pub. Date: May 19, 1988

[30] Foreign Application Priority Data

Nov. 8, 1986 [DE] Fed. Rep. of Germany ..... 3638214
Feb. 19, 1987 [DE] Fed. Rep. of Germany ..... 3705278

[51] Int. Cl.[5] ..... F02D 41/14; F02D 41/10; F02D 41/34

[52] U.S. Cl. ..... 123/436; 123/419; 364/431.08

[58] Field of Search ..... 123/419, 436; 364/431.08

[56] References Cited

U.S. PATENT DOCUMENTS

| | | | |
|---|---|---|---|
| 3,789,816 | 2/1974 | Taplin et al. . | |
| 4,112,879 | 9/1978 | Assenheimer et al. . | |
| 4,197,767 | 4/1980 | Leung . | |
| 4,266,447 | 5/1981 | Heess et al. | 74/858 |
| 4,271,798 | 6/1981 | Seitz et al. | 123/436 X |
| 4,811,224 | 3/1989 | Kuerschner et al. | 123/419 X |

FOREIGN PATENT DOCUMENTS 3526409 2/1986 Fed. Rep. of Germany .

*Primary Examiner*—Tony M. Argenbright
*Attorney, Agent, or Firm*—Walter Ottesen

[57] ABSTRACT

A device for the electronically controlled influencing of actuating devices of an internal combustion engine is proposed in which actuating devices can be influenced by comparing differentiated sensor signals with predeterminable threshold values. The actuating devices are directly accessed without a detour via any regulating devices. The system corresponding to the method thus becomes very simple and inexpensive in its construction. Control-loop-related oscillations are avoided by the direct influencing of the actuating device.

16 Claims, 11 Drawing Sheets

ELECTRONIC CONTROL DEVICE FOR CONTROLLING THE FUEL QUANTITY OF AN INTERNAL COMBUSTION ENGINE

PRIOR ART

In motor vehicles, bucking vibrations having a disturbing effect on the behavior of the motor vehicle are frequently imparted by the interaction of internal combustion engine, elastic suspension and masses capable of vibrating. Such vibrations can also be excited by acceleration or deceleration (overrun operation).

From German published patent application No. 2,906,782, a device for damping bucking vibrations in an internal combustion engine is known. This is based on the concept that the bucking vibrations are associated with distinctly measurable fluctuations in the speed. These speed fluctuations are derived with the aid of the differentiated speed signal. The differentiated speed signal itself is then fed to the fuel quantity control system to counteract the bucking vibrations with the fuel correction signal, which counteracts the bucking vibrations, being a definite function of a speed-dependent signal.

The known device, which directly intervenes in the fuel quantity control system, does not satisfy all operational conditions of a motor vehicle or of an internal combustion engine connected therewith because connecting the differentiated speed signal to the fuel quantity control system can also lead to instabilities in the control loop.

The invention has the object of providing a method for damping bucking in internal combustion engines by means of which, on the one hand, the bucking vibrations are effectively damped, especially during acceleration and in the overrun condition but which, on the other hand, does not directly intervene in the fuel quantity control system.

ADVANTAGES OF THE INVENTION

Compared with the prior art mentioned, the method according to the invention has the advantage of being simple to implement since there is no intervention in the fuel quantity control system. A further advantage can be seen in restricting the speed range in which the bucking damping is to be performed, since this measure saves computing time in the case of control systems having a microcomputer.

DRAWING

The invention will be illustrated in detail and explained with reference to the following drawing.

Description of the Embodiments

Figure 1:
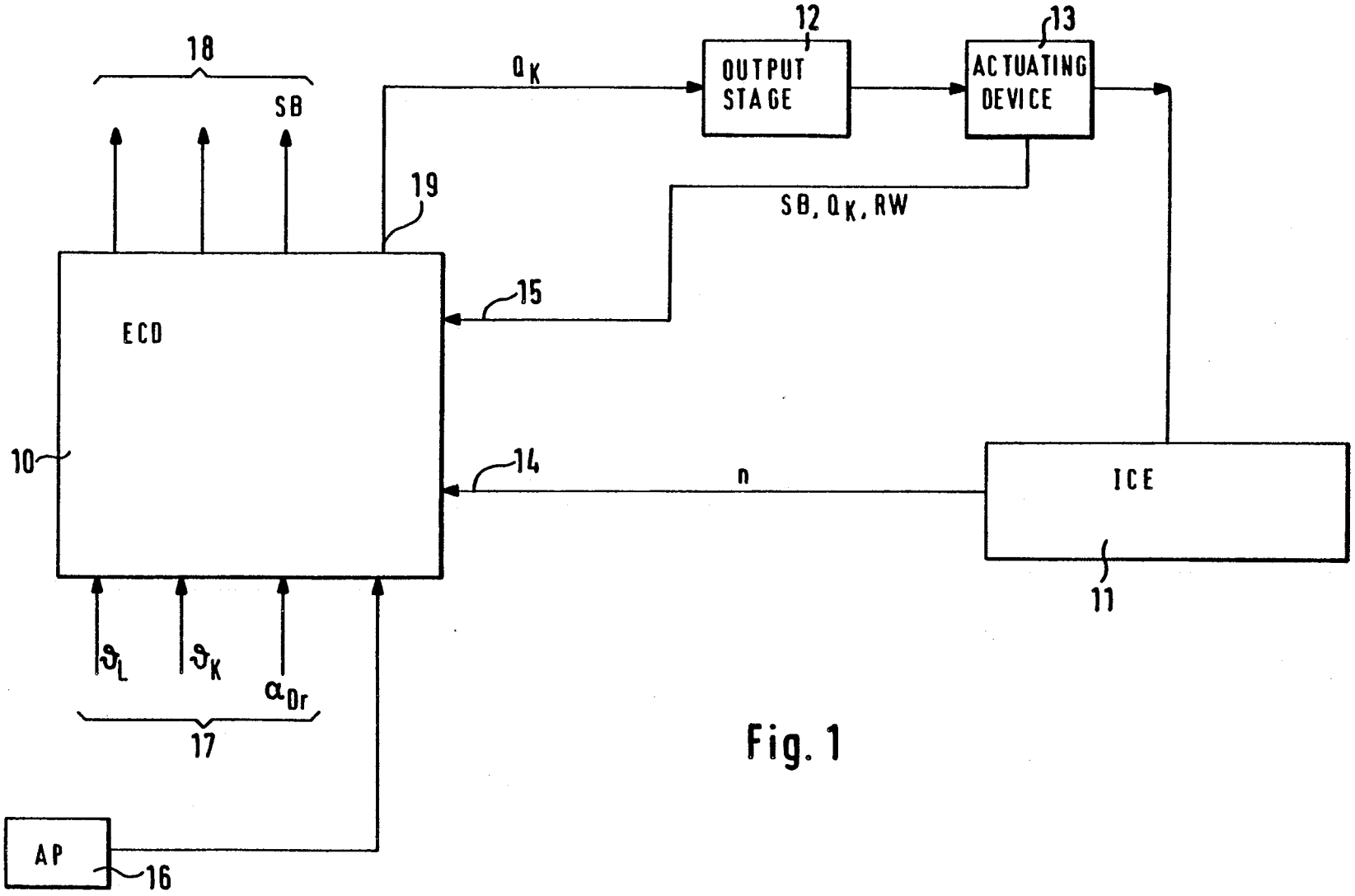
FIG. 1 shows the internal combustion engine with the elements necessary for controlling it, FIGS. 2(A-D) diagrammatically show the operation of the method in the case of acceleration, in the overrun mode and the signal variation of the speed, of the first and the second derivative of the speed during bucking and with fluctuations in uniform speed.

In FIG. 1, 10 designates an electronic control device, 11 an internal combustion engine and 12 an output stage for controlling an actuating device 13. The electronic control device is supplied with sensor signals via inputs 14 to 17. A speed signal is present at input 14, a signal proportional to the fuel quantity $Q_K$ is present at input 15, but the signals of the beginning of injection or of a controlled distance transmitter are also conceivable. 16 designates an accelerator pedal position transmitter, 17 relates to input signals of, for example, the air temperature, the fuel temperature, the engine temperature or the throttle flap position, 18 identifies a group of output signals which include, for example, the beginning of injection or the control rod position. The fuel quantity signal is emitted at output 19. In modern control devices, the electronic control device 10 contains a microcomputer which is connected via interface chips to the input and the output signals. In addition to the microcomputer, various storage units are provided in the control device. Naturally, it is also conceivable that the control device is constructed with analog circuits. However, an analog representation is omitted because of the increasing significance of microcomputer-controlled systems.

In FIG. *2a*, the speed n and the fuel quantity $Q_K$ are plotted against time. The case represented corresponds to the condition of acceleration of a motor vehicle. Starting with a speed value 20, the vehicle is to be accelerated to a speed value designated by 23. In the ideal case, the speed would change in accordance with the curve designated by 22. In real internal combustion engines, however, a speed behavior is observed frequently which corresponds to the line designated by 21. After the acceleration process has started, the speed rises steeply which then results in the bucking vibrations of the motor vehicle connected to the internal combustion engine. The method still to be described in the following is intended to counteract these bucking vibrations. For this purpose, the fuel supply to the internal combustion engine is reduced whenever the speed increases excessively. This is shown in the lower diagram of FIG. *2a*. At the beginning of the acceleration process, the fuel quantity supplied has the value designated by 24. If the actual speed differs too much from the required speed variation, the fuel quantity supplied to the internal combustion engine is lowered to the value designated by 25. Naturally, the fuel quantity values designated by 24 and 25 are not absolute but relative values. The essential factor is that the fuel quantity is reduced if the actual speed deviates too much from the desired course. FIG. *2b* deals with the case of the overrun operation. After interruption of the fuel supply, the drops in speed occurring in real internal combustion engines are frequently too great. If the speed is intended to change from a value designated by 26 to a value designated by 29, it would follow the curve designated by 27 in the ideal case. However, drops in speed corresponding to the line designated by 28 are observed. According to the method, fuel is supplied for a short time in this case to stop the excessive drop in speed. This is shown in the lower diagram of FIG. *2b*. While the fuel supply is interrupted at the beginning of overrun operation, it is started again for a short time if the speed drop is too great.

Figure 2A:
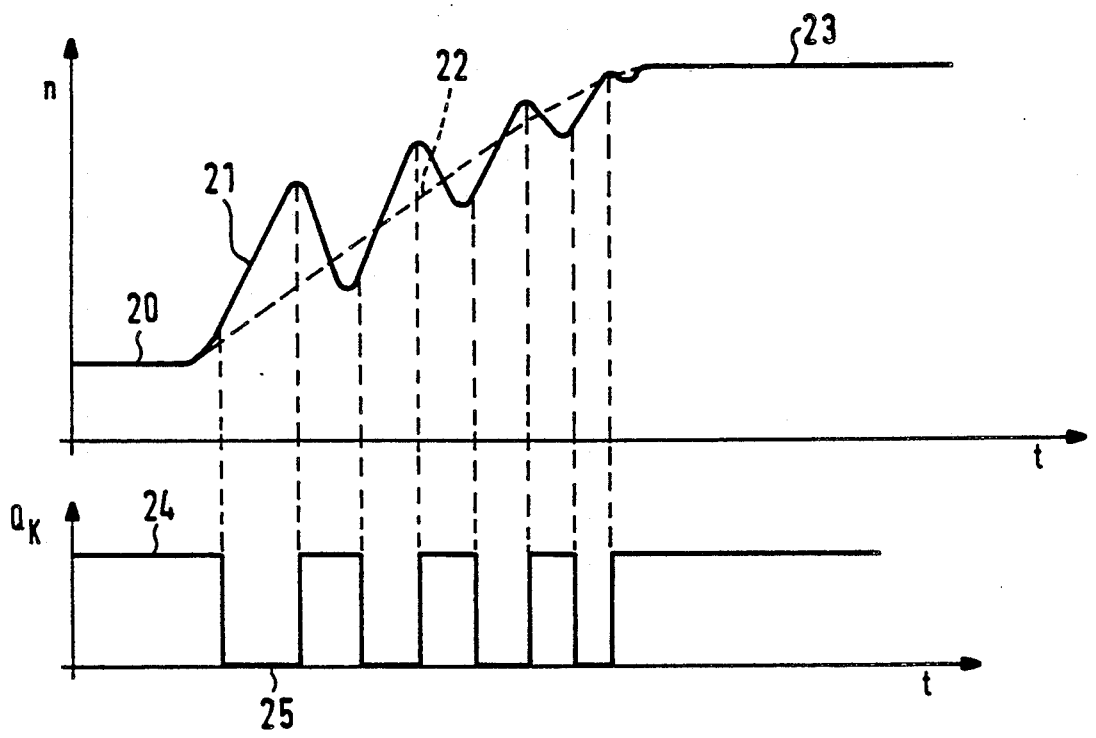
Figure 2B:
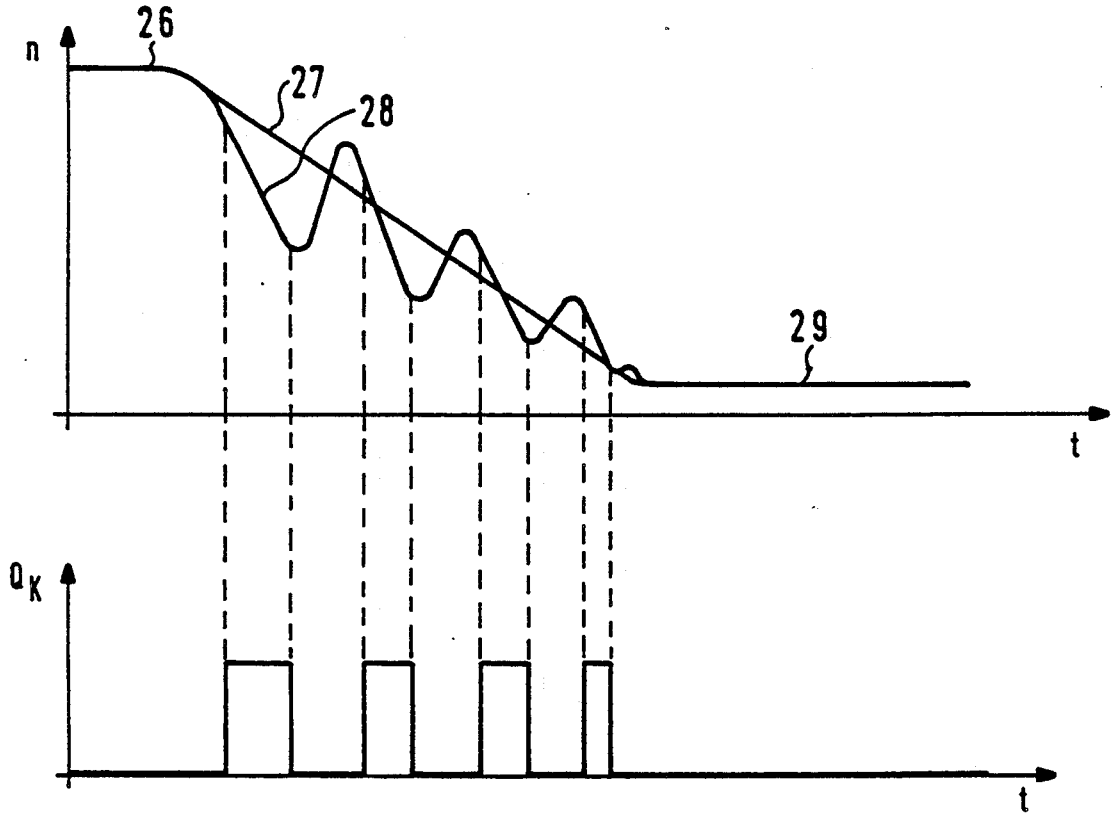
Figure 2C:
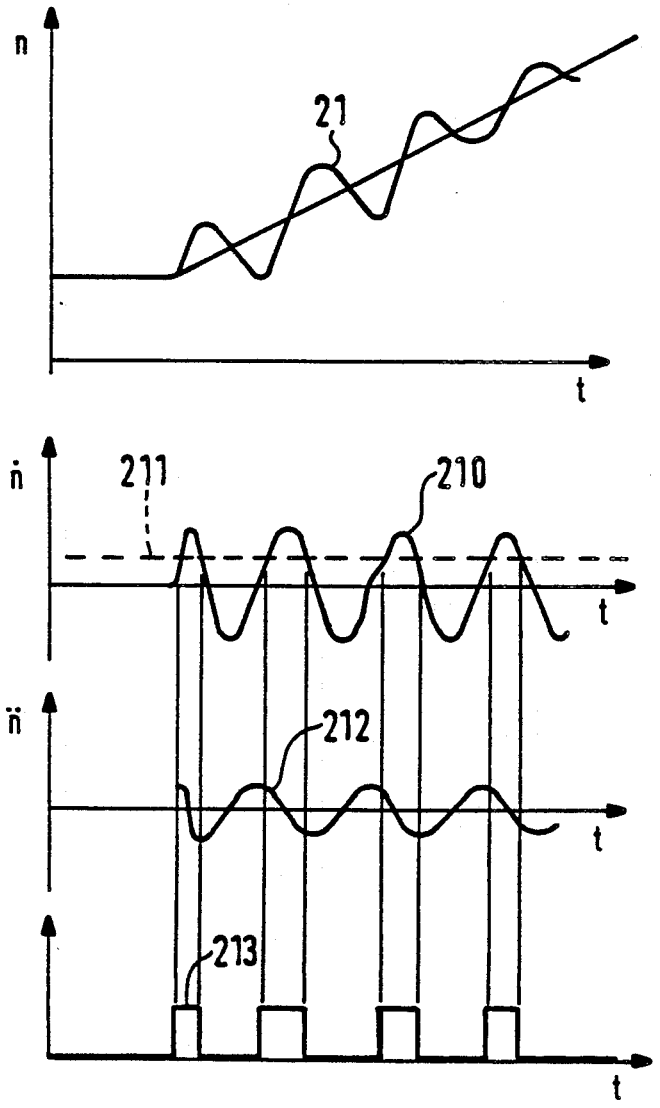
Figure 2D:
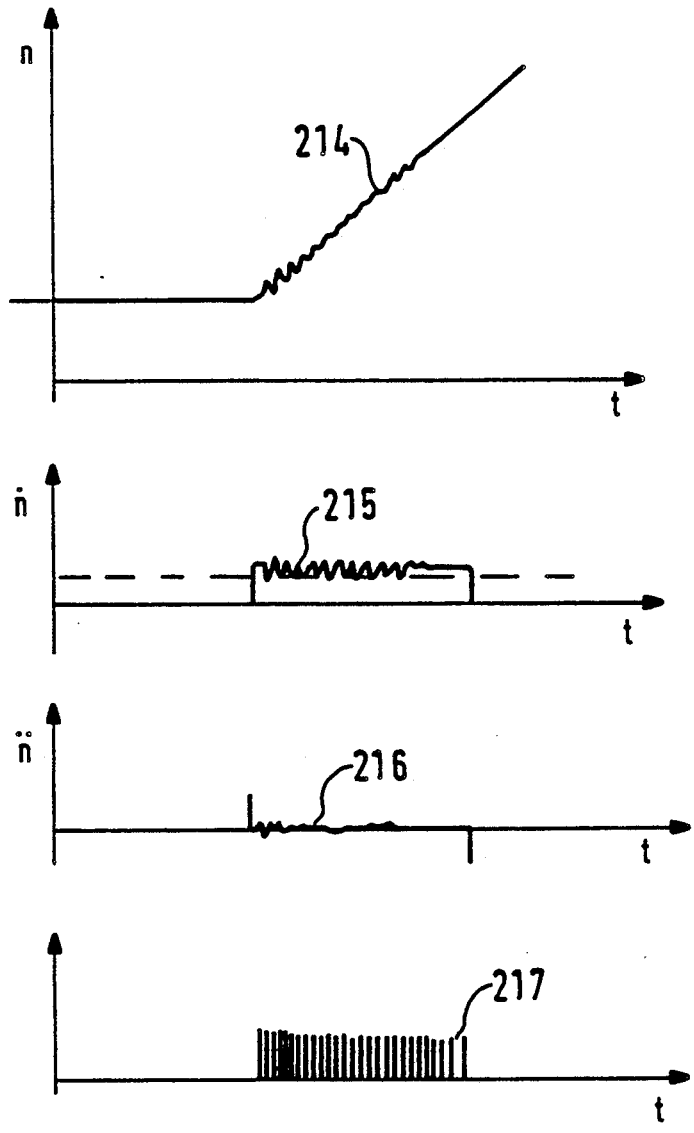

FIGS. 2*c* and 2*d* show the variation of the speed, of the first derivative of the speed and of the second derivative of the speed with time, once for the case of bucking, (FIG. 2*c*), the other time in the case of fluctuations in uniform speed (FIG. 2*d*). In the upper part of FIG. 2*c*, the speed signal n is plotted against time. 21 designates the speed variation against time already mentioned in FIG. 2*a* and frequently observed in real internal combustion engines. In the diagram underneath, 210 designates the first derivative of the speed signal, 211 a threshold for the differentiated speed signal. The differentiated signal 210 leads to a representation according to the curve designated by 212. This curve is the second derivative of the speed signal. The bottom diagram of FIG. 2*c* shows that the fuel quantity is only adjusted when:

1. the first derivative of the speed signal exceeds the threshold 211, and 2. the second derivative of the speed signal distinctly differs from zero.

FIG. 2*d* deals with the case of fluctuations in uniform speed which should not lead to an adjustment of fuel quantity. 214 designates the rising speed signal on which fluctuations in uniform speed are superimposed. The associated differentiated speed signal designated by 215 very rapidly fluctuates between values below the threshold 211 and above the threshold 211. These fluctuations should not cause any fuel quantity adjustment. A switching sequence having the behavior designated by the number 217 in FIG. 2*d* should not occur. This is prevented by observing the second derivative of the speed signal A second derivative of the speed signal according to 216 according to FIG. 2*d* suppresses the fuel quantity adjustment so that bucking and fluctuations in uniform speed can be distinguished from one another by means of this device.

Figure 3B:
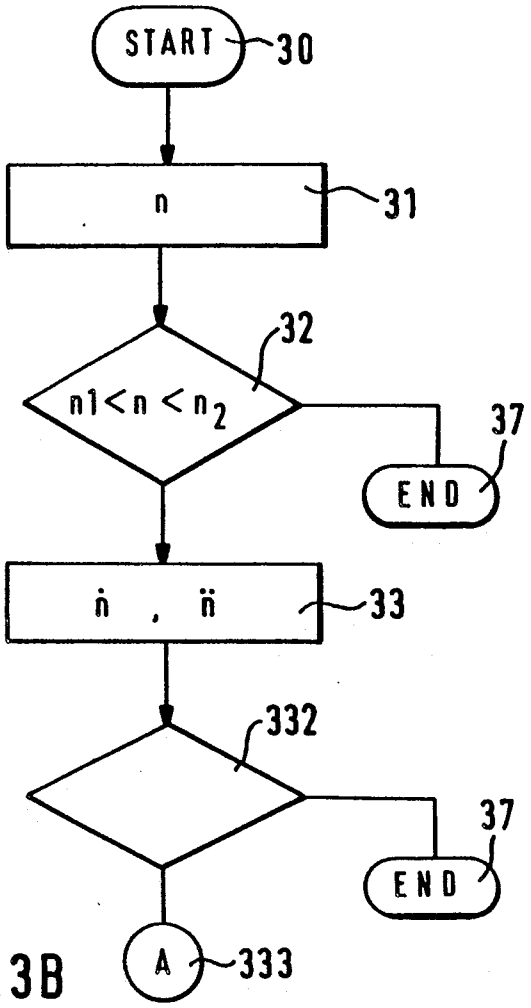
FIGS. 3(A-C) show the sequence of the method steps by means of a flow chart.
Figure 3A:
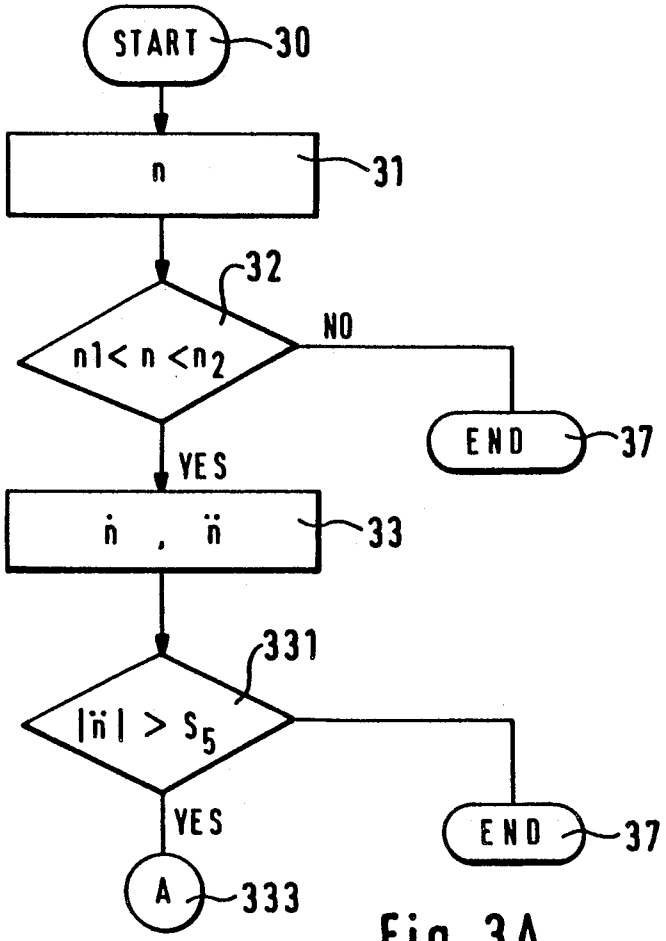
Figure 3C:
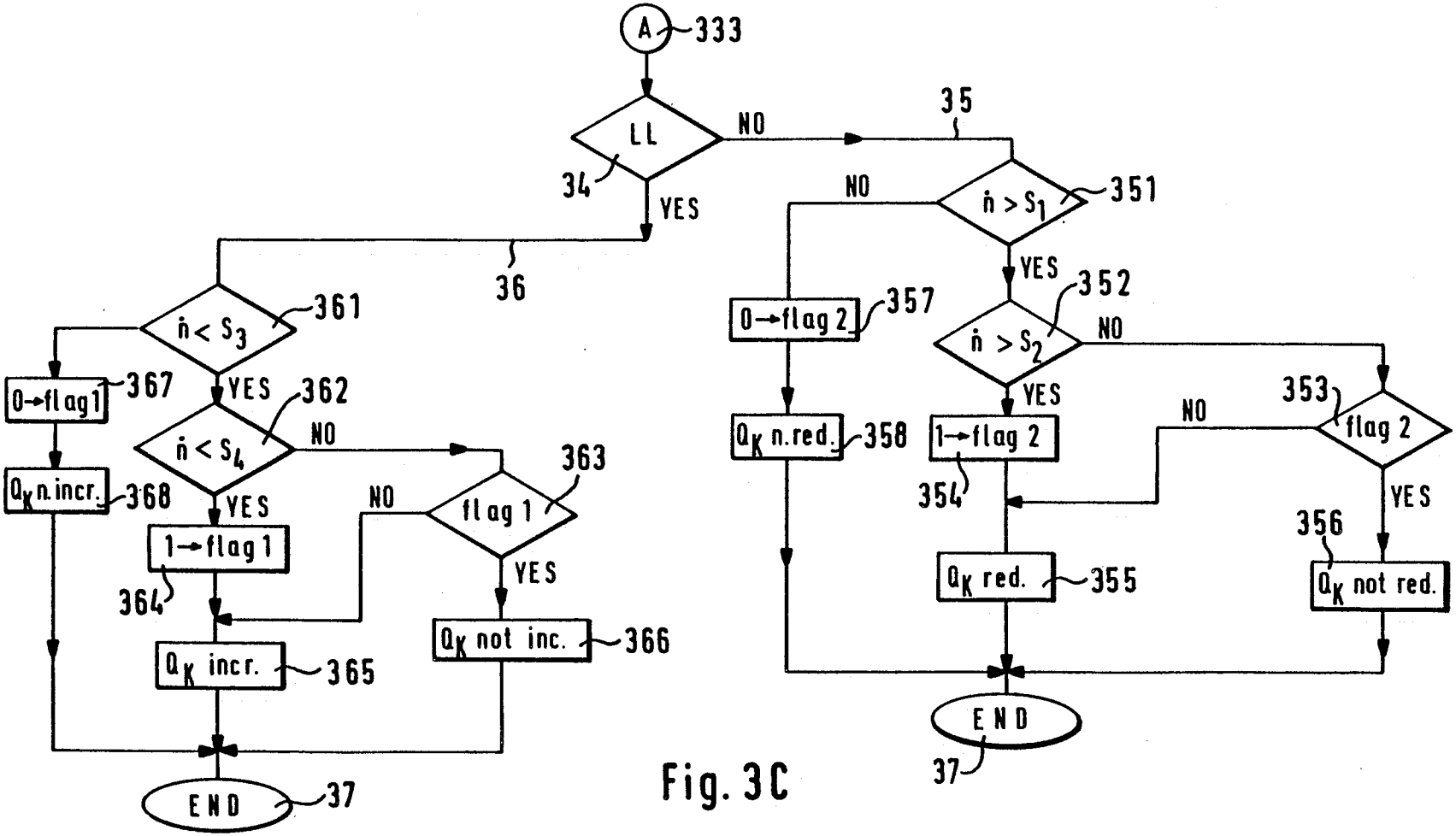

FIG. 3 shows a flow chart which contains the steps necessary for carrying out the method. This flow chart can be considered, for example, as a sub-program of a contained microcomputer in the control device. In the following, the flow chart is considered as a pictorial representation of a sub-program. FIG. 3 is divided into FIGS. 3*a, b and c.* FIG. 3*a* applies to the case where the fuel quantity adjustment is dependent on the second derivative of the speed signal. In the flow chart according to FIG. 3*b*, the fuel quantity adjustment is made dependent on whether the first derivative of the speed is subject to a change in sign or not. Apart from one exception, the following description applies to the two FIGS. 3*a* and 3*b*. The program starts at 30. At 31, the current speed n is read in. In 32, the decision is made whether the current speed is within a predeterminable speed range. This speed range is limited downwards by the speed nl and upwards by the speed n2. If the current speed is outside the required range, the program jumps to the end point 37. If the speed is within the required speed range, the first and the second derivative of the speed, dn/dt and $d^2n/d^2t$, are formed from the speed values read in block 33. In block 331 of FIG. 3*a*, it is checked whether the absolute value of the second derivative is greater than a predeterminable threshold S5. If it is greater, the signal jumps to the point A designated by 333. The following events occur in block 332 of FIG. 3*b*.

In a first step, a check is made whether the first derivative of the speed signal has already once exceeded the first positive threshold Sl or has already once dropped below the first negative threshold S3. Following this, a check is made whether a change in sign occurs for the first derivative of the speed signal. If the change in sign occurs, the program jumps to point A designated by 333. Otherwise, it ends at 37. Point A, at which the program units shown in FIGS. 3*a* and 3*b* are continued, is found again in FIG. 3*c*, designated by 333. In block 34, a check is made whether the idling switch is closed or not. If the idling switch is open, the program branches to block 351 and decides for acceleration of the internal combustion engine. If the idling switch is closed, the program branches to 361. The "idling switch open" case will be dealt with first. At decision stage 351, a check is made whether the first derivative of the speed is greater than a positive threshold Sl. If dn/dt is smaller than this first positive threshold Sl, the value zero is allocated to a flag designated by 2 in block 357. Block 358 outputs that the fuel quantity supplied is not to be corrected. In this case, correction means reduction in the fuel quantity. The program subsequently jumps to its end point 37. However, if the value of the differentiated speed signal is greater than the positive threshold Sl in decision stage 351, a check is made in block 352 whether the value of the differentiated speed signal is greater than a positive threshold S2. The positive threshold S2 is greater than the threshold Sl. If dn/dt is greater than the threshold S2, flag 2 is set in 354. Block 355 outputs that the fuel quantity is to be reduced. The program then ends. If the first derivative of the speed signal was smaller than the second threshold S2, decision block 353 is reached, in which a check is made whether flag 2 is set or not. If flag 2 is set, block 356 outputs that the fuel quantity is no longer to be corrected. The program then ends. If flag 2 is not set, the program jumps back to block 355 which results in a reduction in the fuel quantity.

After the process of acceleration, the overrun mode will now be described. It was found in block 34 that the idling switch was closed. The program then goes to decision stage 361, in which a check is made whether dn/dt is smaller than a first negative threshold S3. If the value of dn/dt is above this threshold, flag 1 is reset in 367. Block 368 outputs that the fuel quantity is not to be increased whereupon the program ends in 37. If during the interrogation in block 361 the value of dn/dt was smaller than the first negative threshold S3, a check is made in block 362 whether dn/dt is also smaller than a second negative threshold S4. If so, flag 1 is set in block 364. Block 365 outputs the command to increase the fuel quantity. The program then ends at 37. If, however, dn/dt was greater than the second negative threshold S4, a check is made in block 363 whether flag 1 is set or not. If flag 1 is set, the decision not to increase the fuel quantity is made in 366, and the program then ends in block 37. If flag 1 was not set, the program branches back to block 365 and the fuel quantity is increased.

Figure 4:
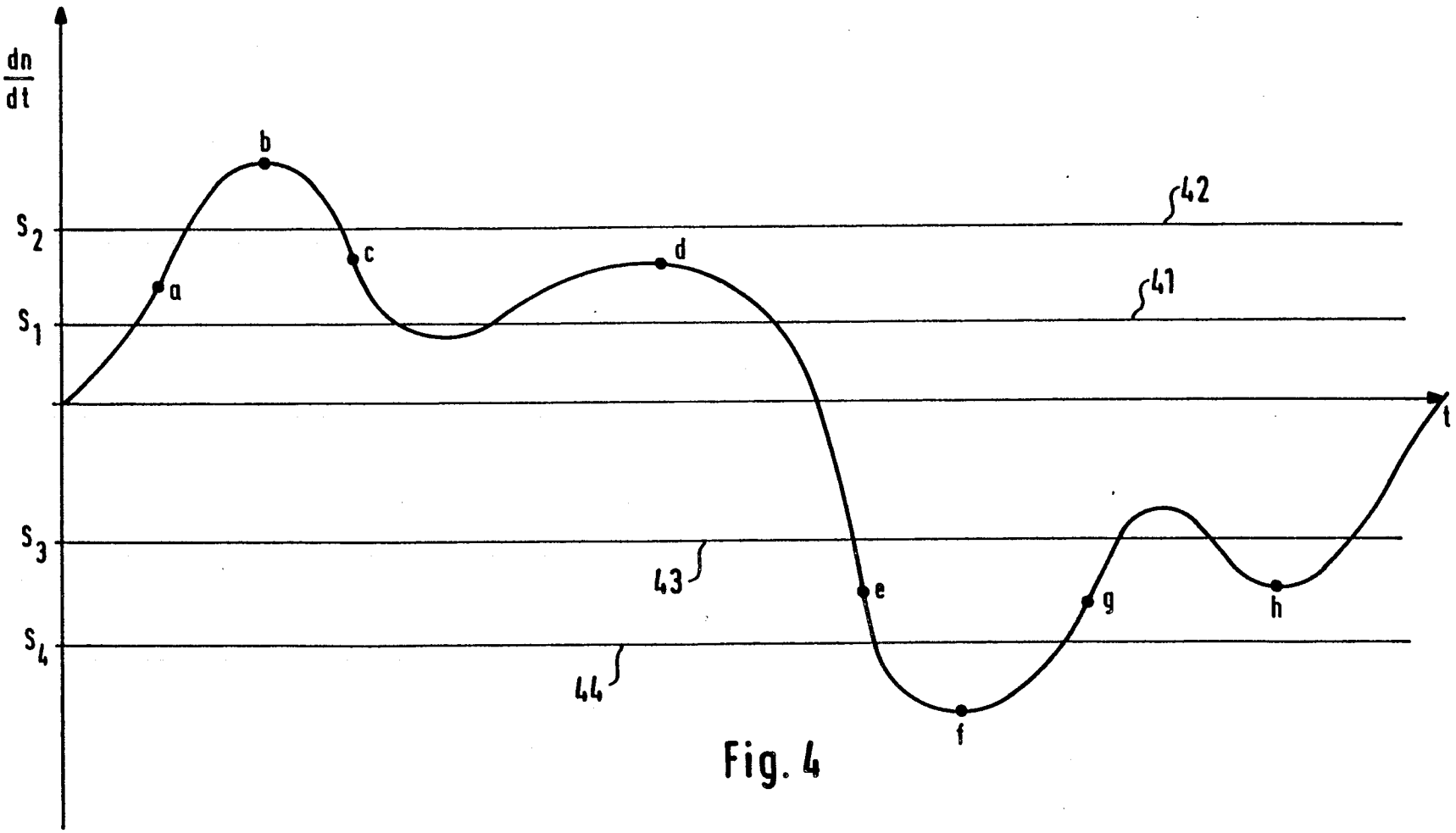
FIG. 4 is used for explaining the flow chart according to FIG. 3.

The operation of the method becomes even clearer with reference to FIG. 4. The first derivative of the speed signal dn/dt is plotted along the ordinate of FIG. 4, and time t is plotted along the abscissa. 41 designates the first positive threshold Sl, 42 the second positive threshold S2. The two negative thresholds S3 and S4 have the reference symbols 43 and 44. The operation of the device is explained with reference to the fictitious waveform and the points a to h. The fuel quantity to be supplied remains unchanged below the positive threshold Sl. At point a, dn/dt has exceeded the first positive threshold Sl. The fuel quantity to be supplied is reduced. If dn/dt continues to increase, for example up to point b, the fuel quantity to be supplied is reduced further. Fuel quantity correction is cancelled only after the curve drops below the second positive threshold S2. Point c is such an operating point. If dn/dt also drops below the first positive threshold, this has no effect initially. If, however, dn/dt rises again without exceeding the second positive threshold (point d) the fuel quantity to be supplied is reduced again. However, the reduction in fuel quantity is now cancelled only when dn/dt again drops below the first positive threshold Sl.

The method operates in a similar manner in the case of drops in speed. Point e is marked as the operating point at which dn/dt has dropped below the first negative threshold S3. It can be seen from the flow chart that the fuel quantity to the internal combustion engine is increased in this case. The fuel quantity is also further increased if dn/dt drops below the second negative threshold S4 (operating point f). The fuel supply to the internal combustion engine is lowered or interrupted only after the second negative threshold S4 (operating point g) is exceeded. Exceeding the first negative threshold S3 has no effect on the fuel quantity supplied. It is only when dn/dt drops below the first negative threshold S3 without dropping below the second negative threshold S4 that the fuel supply is changed. Since this is an overrun mode of operation, the fuel quantity to be supplied is increased (operating point h). The increase is cancelled only when dn/dt exceeds the first negative threshold S3.

Figure 5:
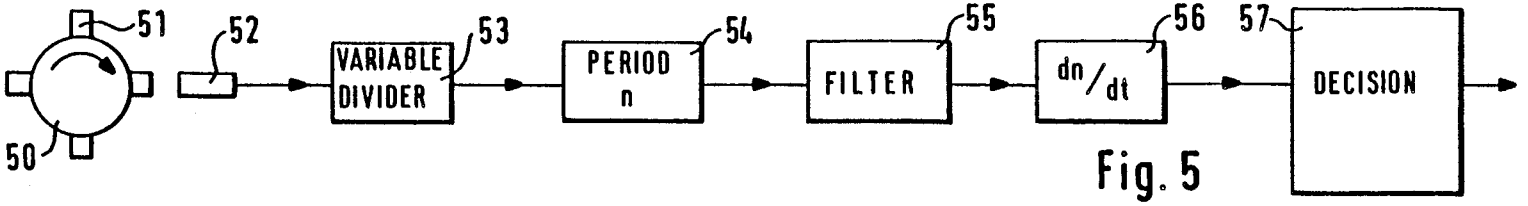
FIG. 5 shows the elements necessary for carrying out the method in a block diagram.

FIG. 5 contains a number of details essential to the carrying out of the method. 50 designates the crank or cam shaft to which reference marks 51 are applied. 52 designates a speed sensor, the output signal of which is supplied to a divider 53 having a variable dividing ratio. The speed n is determined at 54 from the periods measured at 50. The speed signal thus determined is filtered in a filter 55 in order to eliminate interfering components. The filter 55 can be, for example, a first order Chebyshev filter. The filtered speed signal is differentiated in 56 and then fed to a decision stage 57.

Figure 6:
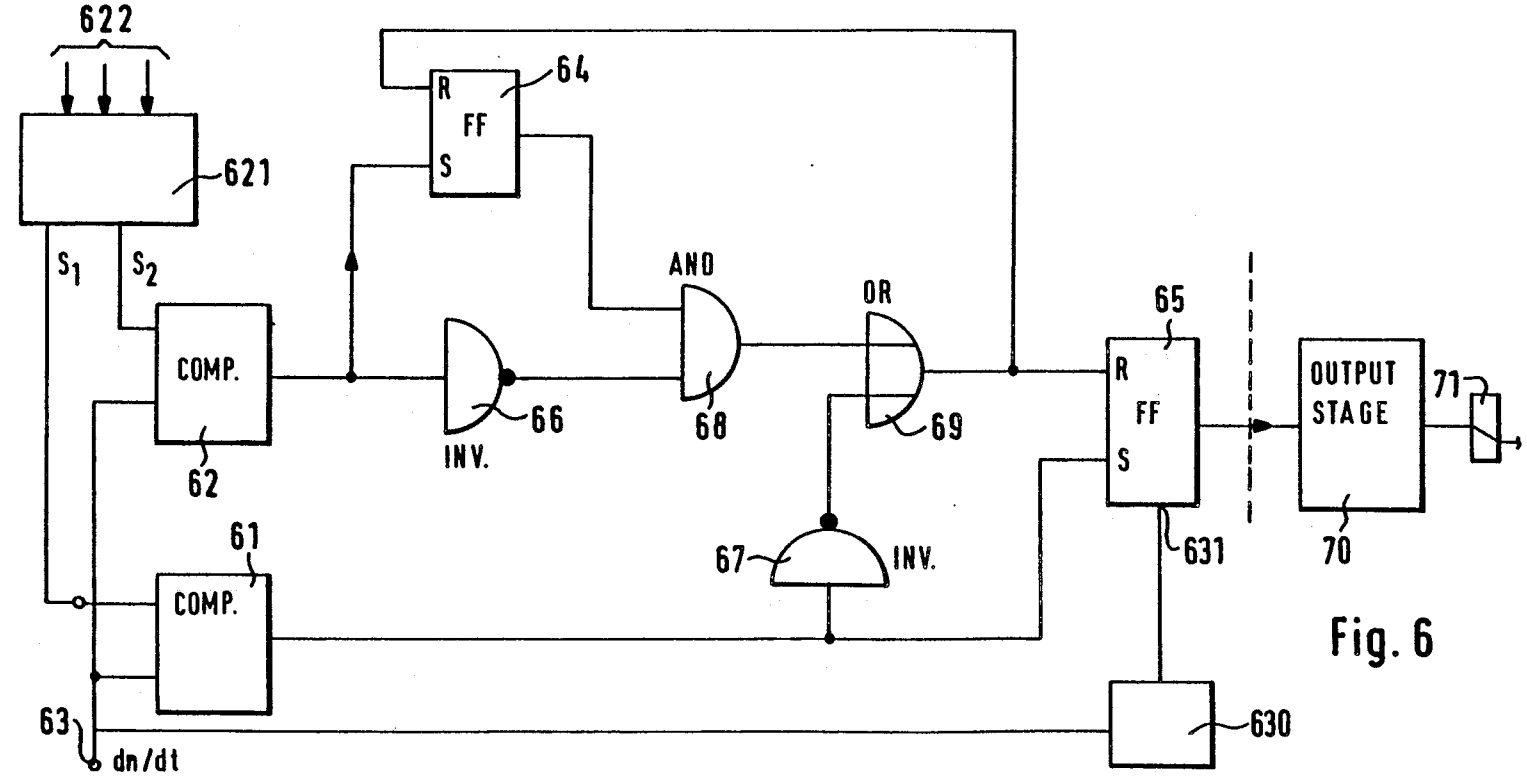
FIG. 6 shows an implementation of the decision stage.

FIG. 6 shows a hardware implementation of the decision stage 57. The differentiated speed signal passes via 63 to the two comparators 61 and 62. Comparator 61 monitors threshold Sl and comparator 62 monitors threshold S2. The output of the comparator 61 is connected to an inverter 67 and to the set input of a flip-flop 65. The output of the comparator 62 is connected, on the one hand, to the set input of a flip-flop 64 and, on the other hand, also to the input of an inverter 66. The output of the inverter 66 and the output of the flip-flop 64 are fed to the AND-gate 68, the output of which is connected to an OR-gate 69. In addition, this OR-gate 69 is supplied with the output of the inverter 67. Reset inputs of the two flip flops 64 and 65 are connected to the output of the OR-gate 69. The output of the flip-flop 65 controls an output stage 70 which, in turn, drives an actuating device 71. A device 630, the output of which influences the inhibit input 631 of the flip-flop 65, is also connected to the input 63. The two thresholds designated by Sl and S2, which are supplied to the comparators 61 and 62, are connected to a device 621 which is supplied at its input with signals of operating parameters of the internal combustion engine via 622. The operation of the device can be easily understood in conjunction with FIG. 4. If dn/dt exceeds the first positive threshold, a logical 1 is present at the output of the comparator 61 which sets the flip-flop 65 and drives the output stage 70. At the output of the inverter 67 a logical zero is present so that a logical zero is also present at the reset input of the flip-flop 65 and at the reset input of the flip-flop 64. If the signal dn/dt exceeds the second positive threshold S2, a logical 1 is also present at the output of the comparator 62. This sets the flip-flop 64 so that a logical 1 is present at its output. After the curve drops below the threshold S2, a logical zero is present at the output of the comparator 62 and a logical 1 at the output of the inverter 66 so that both inputs of the AND-gate 68 are supplied with a logical 1. As a result, a reset pulse passes via the OR-gate 69 to flip-flop 65 so that the influencing of the output stage or of the actuating device is cancelled. The following situation occurs in a case where the signal dn/dt exceeds the first threshold Sl but not the second threshold: After the first threshold Sl is exceeded, a logical 1 is present at the output of the comparator 61. This sets the flip-flop 65. Its output signal influences the output stage and the actuating device 71. If dn/dt drops below the threshold Sl, a logical zero is present at the output of the comparator 61 and a logical 1 at the output of the inverter 67, as a result of which the flip-flop 65 is provided with a reset pulse via the OR-gate 69. This cancels the influencing of the output stage 70 and the fuel quantity is no longer corrected. In the block designated by 630, various operations can be performed. Thus, for example, the possibility exists to differentiate the differentiated speed signal one more time and to allow the flip-flop 65 to switch only whenever the inhibit input 631 of the flip-flop is enabled. Compare also the flow chart according to FIG. 3*a* with respect to this. Another function of the block 630 lies in monitoring the change of sign of the first derivative of the speed signal. If the first derivative does not change sign after a first fuel quantity adjustment, further adjustments are prevented via the inhibit input 631.

The two thresholds Sl and S2 can be controlled in amplitude. This is shown by the block designated by 621. This can be a storage unit which outputs values for the thresholds Sl and S2 in dependence on operating parameters which are supplied via the input 622. Suitable input variables are, for example, the speed, the first derivative of the speed, the engine temperature or the like. For the expert in the field of the electronic control of internal combustion engines, a construction of the device designated by 621 and 630 is not difficult, since it is adequately described in the technical literature.

Naturally, the operation of the device according to FIG. 6, here described for the positive thresholds Sl and S2, also applies to the two negative thresholds S3 and S4. The only difference is in the influencing of the output stage. While the fuel quantity is reduced when the positive thresholds are exceeded, the fuel quantity is increased when the curve drops below the two negative thresholds in order to counteract excessive drops in speed.

Figure 7:
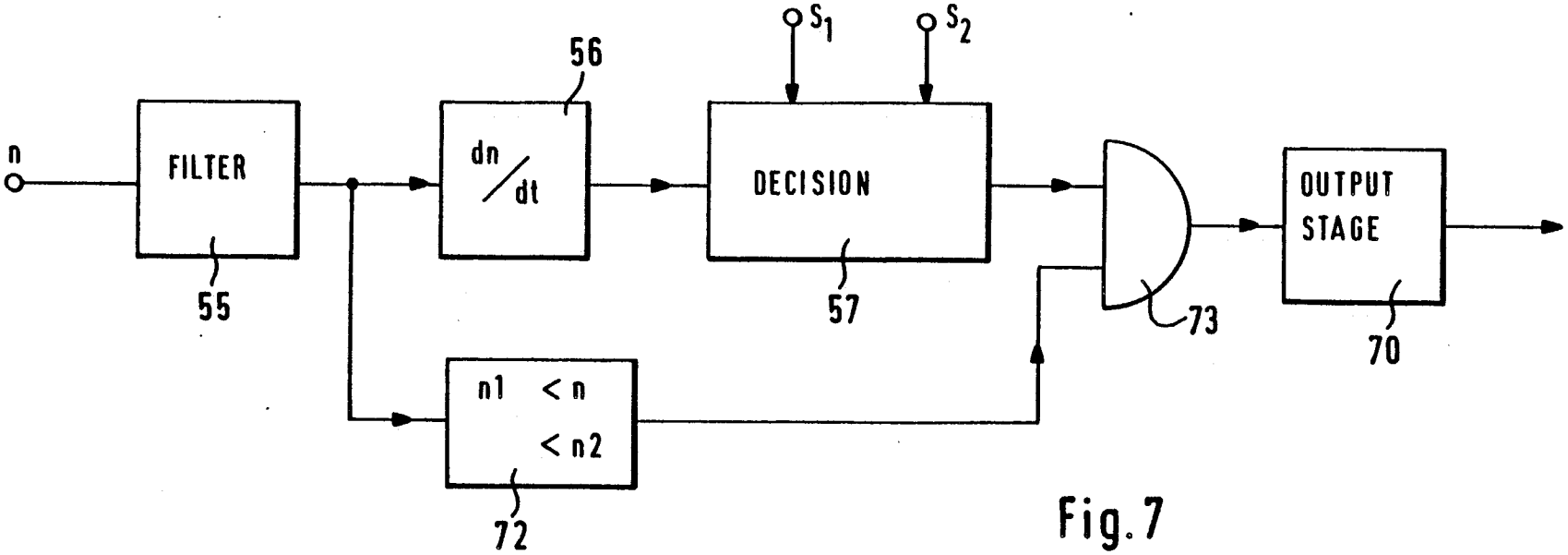
FIG. 7 shows a decision stage with the restriction of the speed range.

FIG. 7 shows a block diagram for the case where the speed range in which the fuel quantity correction is to be performed is restricted. The already known speed signal passes to the filter device 55. From there, it passes, on the one hand, to the window comparator 72 and, on the other hand, to the differentiating device 56. The differentiating device 56 is connected to the known decision stage 57 with its thresholds Sl, S2 or with the thresholds S3 and S4. The output of the window comparator and the output of the decision stage are fed to an AND-gate 73 which is used for driving the output stage 70. The operation of the circuit shown has already been explained in detail during the discussion of the flow chart. The effect of the window comparator 72 is that the fuel quantity is always influenced only within a particular speed range. This provides the computer with considerably more computing time for handling other tasks in all other cases.

Figure 8:
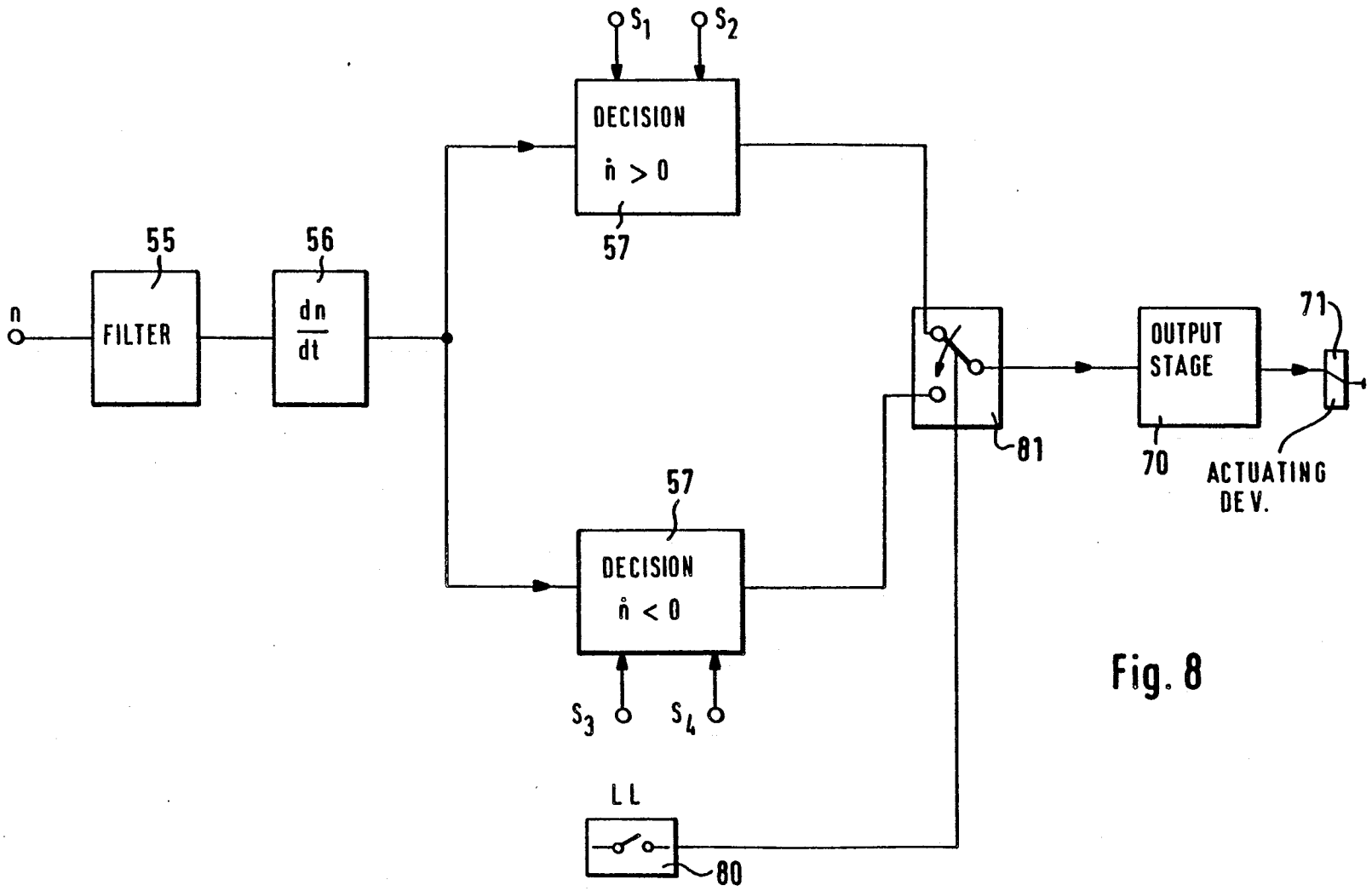
FIG. 8 shows an implementation for negative and positive values of dn/dt.

FIG. 8 shows a hardware implementation which can be used for distinguishing whether the internal combustion engine is in overrun mode or in a state of acceleration. The speed signal n again passes to the filter designated by 55 and from there to the differentiating device 56. The output signal of the differentiating device is fed to two decision stages 57, one of which interrogates for the thresholds Sl and S2 and the other one of which interrogates for the negative thresholds S3 and S4. 80 designates an idling switch which, in the case of idling, switches to the decision stage with the two thresholds S3 and S4, and in the case of acceleration to the decision stage with the thresholds Sl and S2. The output signal of the particular decision stage is then fed to the output stage 70 which, in turn, drives an actuating device 71. The change-over switch carries the reference designation 81.

The situations represented in the block diagrams are solely used for explaining the method. With the present state of microprocessor art, it is easily possible to have the microprocessor perform all the steps necessary for the method. It is thus easy for the expert to find algorithms for the differentiation and filtering of signals. For this purpose, reference is made to the literature relating to these subjects which, in the meantime, is available in large quantities.

We claim:

1. Electronic control device for modulating the fuel quantity of an internal combustion engine, the device having an electrically driveable actuating device which is driven in dependence upon operating conditions of the internal combustion engine, and the device furthermore having sensors for a speed signal which is differentiated at least once during its further processing with the fuel quantity being modulated in dependence upon the differentiated speed signal in such a manner that bucking vibrations are counteracted, characterized in that the fuel quantity metered to the internal combustion engine is reduced when the first derivative of the speed signal exceeds a first threshold (S1); and, in that the reduction is ended when the first derivative of the speed signal drops below a second threshold (S2) with the second threshold being greater than the first threshold.

2. Electronic control device of claim 1, characterized in that, for the case wherein the second threshold (S2) is not reached, the reduction of the fuel quantity is ended when there again is a drop below the first threshold (S1).

3. Electronic control device of claim 1, said speed signal being differentiated at least a second time to form a second derivative thereof, and characterized in that the fuel quantity to be metered to the internal combustion engine is only then modulated when the absolute value of the second derivative of the speed signal is greater than a threshold (S5).

4. Electronic control device according to claim 1, comprising an arrangement for recognizing sign changes in sensor signals, characterized in that the fuel quantity to be metered to the internal combustion engine is modulated when the first derivative of the speed signal changes its sign.

5. Electronic control device according to claim 1, wherein the thresholds for the differentiated speed signal are controlled in dependence upon operating parameters.

6. Electronic control device according to claim 5, wherein the speed or the first derivative of the speed or the second derivative of the speed are used as operating parameters.

7. Electronic control device according to claim 1, wherein the speed signal is derived from the signal of an air mass sensor.

8. Electronic control device according to claim 1, wherein the fuel quantity is modulated only within a predeterminable speed range.

9. Electronic control device according to claim 1, wherein the speed signals are divided with a variable dividing ratio before the evaluation.

10. Electronic control device for modulating the fuel quantity of an internal combustion engine, the device having an electrically driveable actuating device which is driven in dependence upon operating conditions of the internal combustion engine, and the device furthermore having sensors for a speed signal which is differentiated at least once during its further processing with the fuel quantity being modulated independence upon the differentiated speed signal in such a manner that bucking vibrations are counteracted, characterized in that the fuel quantity metered to the internal combustion engine is increased when the first derivative of the speed signal drops below a first threshold (S3); and, in that the increase of the fuel quantity is ended when the first derivative of speed signal exceeds a second threshold (S4) with the second threshold being less than the first threshold.

11. Electronic control device of claim 10, characterized in that for the case wherein the second threshold (S4) is not reached, the increasing of the fuel quantity is then ended when there again is a drop below the firs threshold.

12. Electronic control device of claim 10, wherein the speed signal is derived from the signal of an air mass sensor.

13. Electronic control device of claim 10, wherein the fuel quantity is modulated only within a predeterminable speed range.

14. Electronic control device of claim 10, wherein the speed signals are divided with a variable dividing ratio before the evaluation.

15. Electronic control device of claim 11, wherein the speed signals are filtered before differentiation.

16. Electronic control device of claim 15, wherein a first-order Chebyshev filter is used for filtering.

* * * * *

UNITED STATES PATENT AND TRADEMARK OFFICE

CERTIFICATE OF CORRECTION

PATENT NO. : 4,993,389

DATED : February 19, 1991

INVENTOR(S) : Frank Ahlborn et al

It is certified that error appears in the above-identified patent and that said Letters Patent is hereby corrected as shown below:

On the title page, under reference numeral [75]: delete "Herbert Käberer" and substitute -- Herbert Kälberer -- therefor.

In column 3, line 34: between "signal" and "A" please insert -- . --.

In column 3, line 42: delete "contained mircocomputer" and substitute -- microcomputer contained -- therefor.

In column 8, line 34: delete "independence" and substitute -- in dependence -- therefor.

In column 8, line 47: delete "firs" and substitute -- first -- therefor.

In column 8, line 48: delete "threshold." and substitute -- threshold (S3). -- therefor.

Signed and Sealed this

Twenty-eighth Day of July, 1992

*Attest:*

DOUGLAS B. COMER

*Attesting Officer*

*Acting Commissioner of Patents and Trademarks*